US007183990B2

(12) United States Patent
Amyotte et al.

(10) Patent No.: US 7,183,990 B2
(45) Date of Patent: Feb. 27, 2007

(54) APERTURE ILLUMINATION CONTROL MEMBRANE

(75) Inventors: Eric Amyotte, Laval (CA); Luis Martins-Camelo, Bainsville (CA)

(73) Assignee: EMS Technologies Canada Ltd, Ste-Anne-de-Bellevue (CA)

( * ) Notice: Subject to any disclaimer, the term of this patent is extended or adjusted under 35 U.S.C. 154(b) by 0 days.

(21) Appl. No.: 11/048,824

(22) Filed: Feb. 3, 2005

(65) Prior Publication Data

US 2005/0200546 A1 Sep. 15, 2005

Related U.S. Application Data

(60) Provisional application No. 60/541,243, filed on Feb. 4, 2004.

(51) Int. Cl.
*H01Q 13/00* (2006.01)

(52) U.S. Cl. ..... 343/779; 343/776

(58) Field of Classification Search ..... 343/772, 343/775, 777, 779, 781 R, 783, 912, 798, 343/839, 878, 761
See application file for complete search history.

(56) References Cited

U.S. PATENT DOCUMENTS

| | | | | |
|---|---|---|---|---|
| 3,852,765 | A * | 12/1974 | Bresler et al. | 343/781 R |
| 4,223,316 | A * | 9/1980 | Drabowitch | 343/781 P |
| 4,376,940 | A * | 3/1983 | Miedema | 343/840 |
| 6,140,978 | A | 10/2000 | Patenaude et al. | |
| 6,295,034 | B1 * | 9/2001 | Brown et al. | 343/781 CA |
| 6,421,022 | B1 | 7/2002 | Patenaude et al. | |
| 6,563,472 | B2 | 5/2003 | Durham et al. | |
| 6,759,994 | B2 | 7/2004 | Rao et al. | |
| 6,977,622 | B2 * | 12/2005 | Hay et al. | 343/781 P |

* cited by examiner

*Primary Examiner*—Shih-Chao Chen
*Assistant Examiner*—Minh Dieu A
(74) *Attorney, Agent, or Firm*—Protections Equinox Int'l Inc.; Franz Bonsang

(57) ABSTRACT

A device for modifying electromagnetic illumination of a reflector aperture defined by a reflector surface is mounted in front of the reflector aperture in a spaced apart relationship relative to the reflector surface. The device at least partially covers the reflector aperture and provides an illumination control means for at least partially and selectively modifying electromagnetic illumination of the reflector aperture. The device may include a membrane-like substrate that is substantially transparent to electromagnetic radiation. A supporting member may support the substrate in the spaced apart relationship relative to the reflector surface.

23 Claims, 3 Drawing Sheets

APERTURE ILLUMINATION CONTROL MEMBRANE

CROSS REFERENCE TO RELATED APPLICATION

This application is related to U.S. provisional application for patent Ser. No. 60/541,243 filed on Feb. 4, 2004.

FIELD OF THE INVENTION

The present invention relates to the field of electromagnetic signal antennae and is more particularly concerned with a device or membrane for modifying the aperture illumination of an antenna reflector.

BACKGROUND OF THE INVENTION

A reflector antenna aperture illumination function determines the far-field radiative properties of the antenna, specifically the beam-width and sidelobe levels. Together with the spill-over efficiency associated with the reflector feed system and overall geometry, the aperture illumination function also controls the directivity of the antenna. It follows that the antenna design optimization must aim at realizing an aperture illumination function which is consistent with achieving the required far-field performance characteristics. It would thus appear that an adequate selection of antenna geometry and feed design should be able to realize the desired aperture illumination function, however in practice that is often not possible through the use of conventional design techniques.

Multiple-spot-beam antennas are an example of designs for which each feed horn diameter is limited by the constraints of a tightly packaged multi-horn feed assembly. In that case, the limited horn aperture size is often insufficient to enable achieving the desired aperture illumination function, and particularly the illumination edge taper characteristic of a low sidelobe design. Moreover, the optimal aperture illumination function for simultaneous sidelobe and beam-width control is often not a smooth monotonic decreasing intensity towards the edges of the aperture, as can be achieved by excitation with a single feed horn, but rather has variations in both the illumination function and its derivative which are unachievable using realizable feed elements.

Multi-frequency designs are another example for which the desired illumination functions are not easily achieved simultaneously for all frequencies. A typical problem encountered by the designer is that multi-frequency feeds excite the reflector aperture with different illumination functions at different frequencies, resulting in different far-field characteristics at those frequencies, whereas similar performances, including beam-width, directivity, and sidelobe levels, are usually desired. Often the design is geared to favor one of the frequency bands, commonly the lowest frequencies at which the antenna directivity will naturally tend to be lowest, to the detriment of the performance at other frequencies. The ideal situation would be instead to be able to design multi-frequency feeds generating reflector aperture illumination functions which are different at the different frequencies but in a controlled manner, so as to closely compensate for the different aperture diameter-to-wavelength ratios. Multi-frequency feed designs are therefore a critical factor in achieving similar performance at different frequencies, however feed optimization, albeit able to push the reflector antenna design closer to multi-frequency performance equalization, is unable to meet the most ambitious design requirements.

U.S. Pat. Nos. 6,140,978 and 6,421,022 granted to Patenaude et al. on Oct. 31, 2000, and Jul. 16, 2002 respectively, and U.S. Pat. No. 6,563,472 granted to Durham et al. on May 13, 2003 disclose frequency-selective patterns integrated into the design of reflectors. U.S. Pat. No. 6,759,994 granted to Rao et al. on Jul. 6, 2004 discloses a partially reflective surface also integrated into the design of the reflectors. Although modifying the construction of the reflector allows a certain control of the reflector illumination, the solutions proposed by Patenaude et al., Rao et al. and Durham et al. are generally expensive and relatively complex to design, manufacture and test. They are also more susceptible to thermo-elastic distortions since the coefficient of thermal expansion for the outer section of the reflector is typically much higher than that of carbon fiber. This disadvantage makes it unattractive for high frequency applications such as Ka-Band.

Accordingly, there is a need for an improved reflector aperture illumination control device to enhance the overall performance of an antenna.

SUMMARY OF THE INVENTION

It is therefore a general object of the present invention to provide a reflector aperture illumination control device or membrane that improves the overall performance of an antenna.

The proposed device of the present invention is a membrane located in front of an antenna reflector aperture in a spaced apart relationship therewith and incorporated in the design of the antenna. The membrane has typically, radially and/or circumferentially, non-uniform and pre-determined RF (Radio-Frequency) reflection and/or absorption coefficient characteristics such that, when combined with a given horn radiation pattern, it provides the required controlled or modified aperture illumination function. By tight control of the aperture illumination function, far-field pattern characteristics such as beam-width, directivity, and sidelobe levels can be either optimized at the frequency of interest, or simultaneously optimized at multiple frequencies.

The proposed device can be advantageously implemented as an aperture membrane or sheet, for example as a part of a conventional spaced apart reflector sunshield. In its multiple-frequency embodiment, the device or membrane exhibits non-uniform pre-determined frequency-sensitive properties which can be provided, for example and by no means as of limitation, by periodic metallic (electrically conductive) patterns etched on the membrane substrate, with geometry and properties which change in an optimized manner (for example, the variation may be implemented in a radial direction from the center of the aperture toward the edges of the aperture). In each frequency of operation, the transmission and reflection coefficients are thus optimized so as to result in the desired aperture illumination function. In the single-frequency multi-beam design, the membrane can be realized also as a non-uniform pre-determined frequency-sensitive structure with transmission (reflection and/or absorption) characteristics optimized over a single frequency band. In either case, dielectric loading with an electrically lossy and/or conductive material (such as carbon or the like) can also be used, in isolation or in conjunction with a periodic metallic frequency-sensitive pattern, so as to add a controlled or modified transmission pre-determined profile to the desired absorption and reflection properties of the overall electrically lossy membrane.

When combined with judicious selection of the reflector antenna geometry as well as reflector surface shaping if required, this proposed novel design enables realizing great mass, volume, and cost advantages without the performance degradation severity of conventional multi-beam and multi-frequency designs, as needed for typical spaceborne applications.

An advantage of the aperture illumination control device or membrane is that it does not alter the design of the reflector (or sub-reflector), which can be independently designed to provide the optimal balance amongst cost, mass, thermal stability, and electrical performance. The proposed device is a low-mass, low-cost addition (filter) that controls the illumination of this optimal reflector.

The device of the present invention can be used to shape the incident and/or reflected beam from the reflector (or sub-reflector) to provide a contoured beam.

According to an aspect of the present invention, there is provided a device for modifying electromagnetic illumination of a reflector aperture defined by a reflector surface, the device mounting in front of and substantially overlapping the reflector aperture in a spaced apart relationship relative to the reflector surface and extending to a proximity of a reflector outer edge all around a perimeter of the reflector aperture, thereby at least partially covering the reflector aperture, said device providing an illumination control means for at least partially and selectively modifying electromagnetic illumination of the reflector aperture.

In one embodiment, the device further includes a substrate for mounting in a spaced apart relationship relative to the reflector surface, said substrate being substantially transparent to electromagnetic radiation, said substrate at least partially covering the reflector aperture, said illumination control means connecting to said substrate for at least partially and selectively modifying electromagnetic illumination of the reflector aperture.

In one embodiment, the substrate is in a non-uniform spaced apart relationship relative to the reflector surface.

Typically, the reflector surface defines a reflector axis generally perpendicular thereto, and wherein the illumination control means selectively modifies electromagnetic illumination of the reflector aperture in a substantially radial and/or circumferential direction.

In one embodiment, the illumination control means includes RF transmission and/or absorption and/or reflection coefficient profile that follows a pre-determined pattern.

Typically, the substrate is a support mesh or sheet, and most frequently entirely covers the reflector aperture.

In one embodiment, the illumination control means is a frequency-sensitive property pattern connected to at least a surface of the substrate.

Typically, the frequency-sensitive property pattern includes an RF reflection coefficient profile that follows a pre-determined reflective pattern supported by at least a surface of said substrate and/or an RF absorption coefficient profile that follows a pre-determined absorptive pattern connected to at least a surface of said substrate.

Typically, the pre-determined reflective or absorptive pattern selectively modifies electromagnetic illumination of the reflector aperture in a substantially radial and/or circumferential direction.

In one embodiment, the electrical conductive elements are metallic.

Typically, the electrical conductive elements are etched on at least a surface of said substrate.

In one embodiment, the pre-determined absorptive pattern includes an electrically lossy sheet material having a pre-determined thickness profile.

In one embodiment, the substrate is said electrically lossy sheet material.

In one embodiment, the pre-determined absorptive pattern includes at least one electrically lossy sheet material mounted on at least a surface of said substrate, said electrically lossy sheet material covering at least a portion of said substrate surface so as to provide said pre-determined absorptive pattern.

In one embodiment, the device further includes a supporting member for supporting said substrate in a spaced apart relationship relative to the reflector surface.

Typically, the supporting member in substantially transparent to electromagnetic radiation.

In one embodiment, the supporting member is a mesh.

In one embodiment, the substrate includes a plurality of sheets spaced apart from one another.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
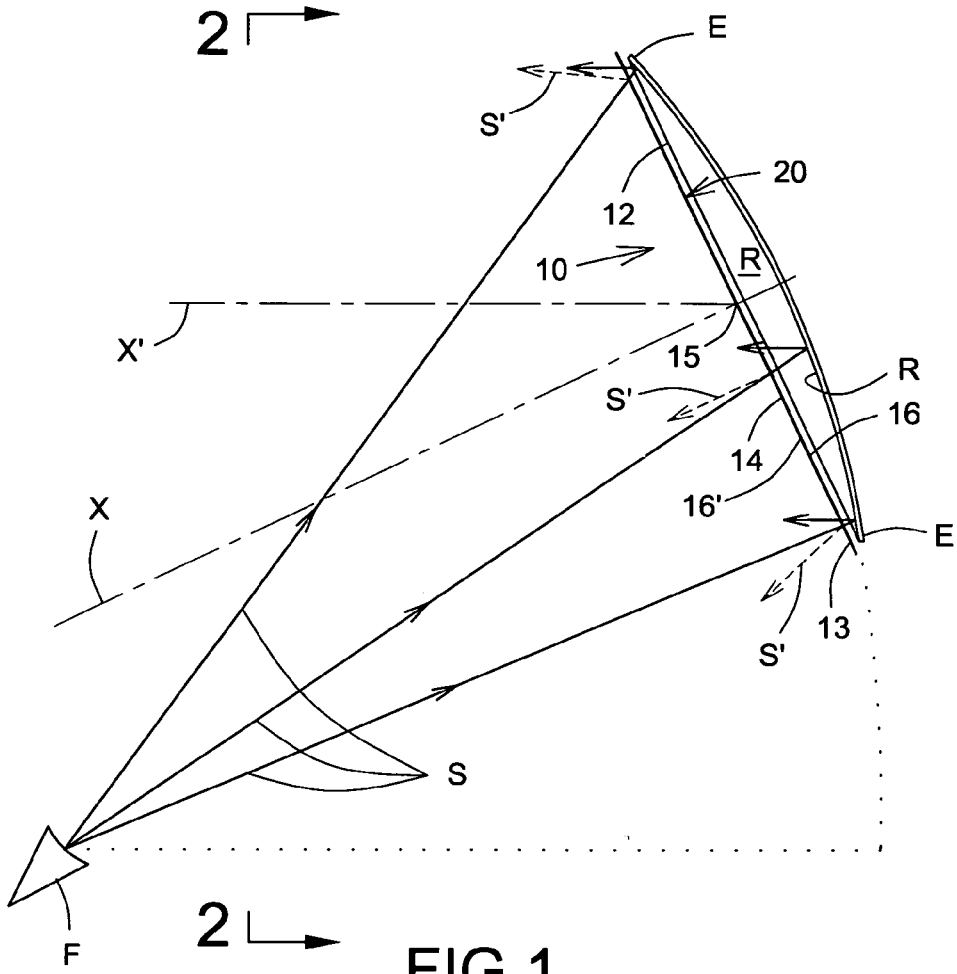
FIG. 1 is a simplified side elevation view of an embodiment of an aperture illumination control device in accordance with the present invention with a generally planar configuration.

Referring to FIG. 1, there is schematically shown an embodiment of a device or membrane 10 in accordance with the present invention for modifying the electromagnetic illumination of an aperture 12 defined by the surface R of a typical antenna reflector having a reflector axis X generally perpendicular thereto. The reflector membrane 10 includes a typically flexible substrate 14, with a typically planar configuration, mounted in front of the reflector aperture 12 in a non-uniform spaced apart relationship relative to the reflector surface R over the reflector aperture 12, typically mounted adjacent the outer edges E of the concave reflector R and generally facing the signal feed F. The distance between the membrane 10 and the reflector surface R is typically non-uniform there over such that the membrane 10 does not generally conform to or assume the shape of the reflector surface R. The substrate 14 is substantially transparent to electromagnetic radiation (Radio-Frequency (RF) transparent) and at least partially covers the reflector aperture 12. The substrate 14 defines generally opposed first and second substrate surfaces 16, 16' thereof oriented toward and away from the reflector surface R.

Figure 5:
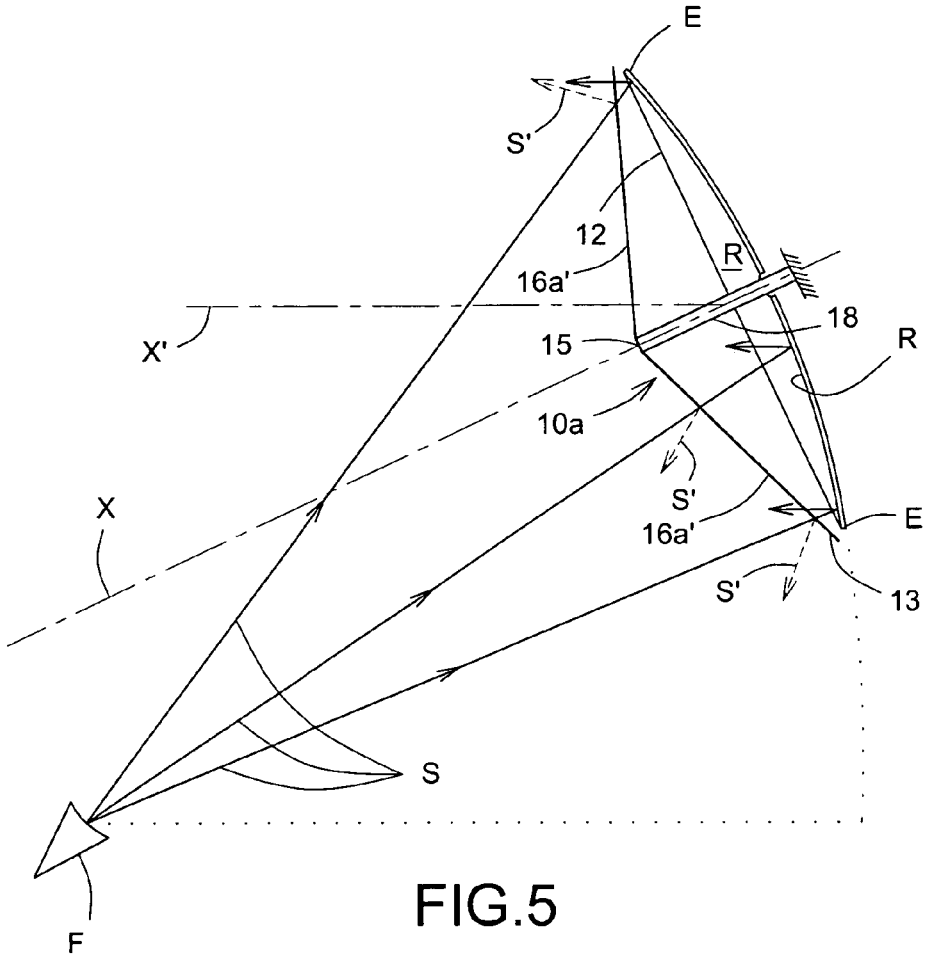
FIG. 5 is a view similar to FIG. 1, showing another embodiment of an aperture illumination control device in accordance with the present invention with a supporting post member providing a tent-shaped configuration changing the distance relative to the reflector surface.

As shown in FIG. 5, the reflector membrane 10*a* could have a non-planar configuration, such as a tent-shaped configuration defined by a supporting member 18 such as a membrane support post 18 or the like, that changes the distance between the membrane 10*a* and the reflector surface R without departing from the scope of the present invention. Typically, such a configuration allows the portion S' of the incident signal S first reflecting on the membrane surface 16*a*' to reflect in a direction leading away form the reflector axis X and out of the reflector coverage area to substantially avoid multi-path degradation of the signal S. Accordingly, the electrical impact of the portion S' of the signal S reflected by the device 10*a* on the transmitted signal is minimized. Typically, the supporting member 18 can be used to geometrically configure the membrane 10*a* in any shape that is suited to a specific application. For example, spacers (not shown) could be used along the periphery or outer edge E of the reflector, and the center of the membrane 10*a* could be attached to an area adjacent the center of the reflector surface R, to provide another configuration that suitably redirects the signal S' which is the reflection of the signal S. Non-conical shaped could also be achieved by introducing supporting members 18 of different length in various locations of the reflector.

Figure 2:
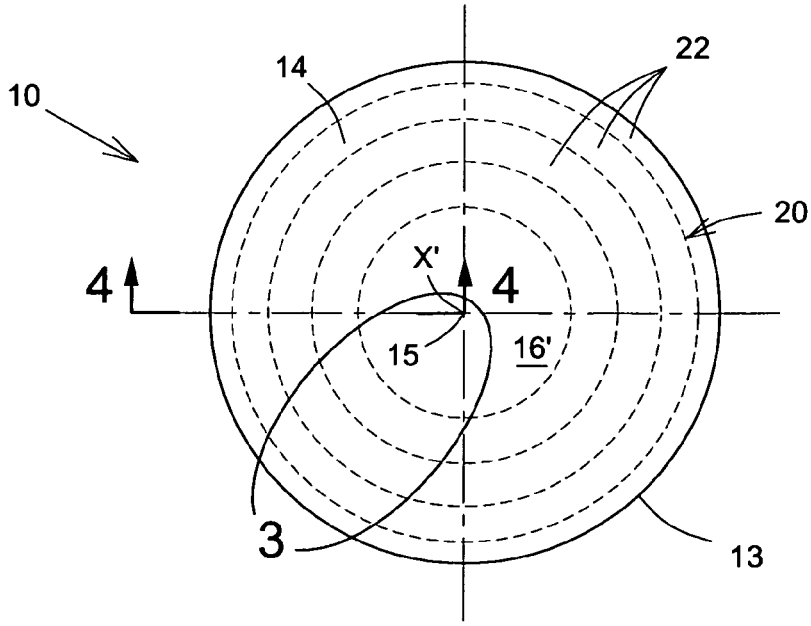
FIG. 2 is a simplified schematic view taken along line 2—2 of FIG. 1, showing a directional projection of a typical pattern of the illumination control means, although a radial variation of the transmission properties are shown, it is provided as an example and by no means as of limitations to radial variation functions.

The reflector device 10 further provides for an illumination control means 20 typically connecting to the first substrate 14 for at least partially and selectively modifying, typically in a substantially radial (shown in FIG. 2) and/or circumferential directions, the electromagnetic illumination of the reflector aperture 12, as shown in FIG. 2. The illumination control means 20 is typically mounted on the first substrate surface 16. Alternatively, the illumination control means 20 could mount either on the second substrate surface 16' or eventually on both surfaces 16, 16' without departing from the scope of the present invention.

Typically, the substrate 14 is a substantially RF transparent support sheet made out of polyester such as Mylar®, polytetrafluoroethylene (PTFE) and fluorinated ethylene propylene (FEP) such as Teflon®, tetrafluoroethylene (TFE), polystyrene, polypropylene, polyethylene, polycarbonate, polyimide such as Kapton®, Nomex®, Kevlar® or the like. Obviously the substrate 14 could include at least one substantially RF transparent coating (not shown) applied on the either substrate surface 16, 16' without departing from the scope of the present invention. The illumination control means 20 is typically mounted on the substrate 14 although it could be formed directly by the substrate 14 itself, since its actual RF transparency is affected by its thickness.

The substrate 14 typically entirely covers the reflector aperture 12 since it is preferably simultaneously used as a sunshield or the like therefore.

The illumination control means 20 has a typically frequency-sensitive property pattern 22 determined by the overall RF transmission thereof in a plurality of pattern zones, that includes an RF reflection coefficient profile that follows a pre-determined reflective pattern 24 and/or an RF absorption coefficient profile that follows a pre-determined absorptive pattern 26.

Obviously, for an example case of a single frequency reflector, the illumination control means 20 includes RF transmission and/or absorption and/or reflection coefficient profile that follows a pre-determined pattern 22, without being frequency-sensitive.

Figure 3:
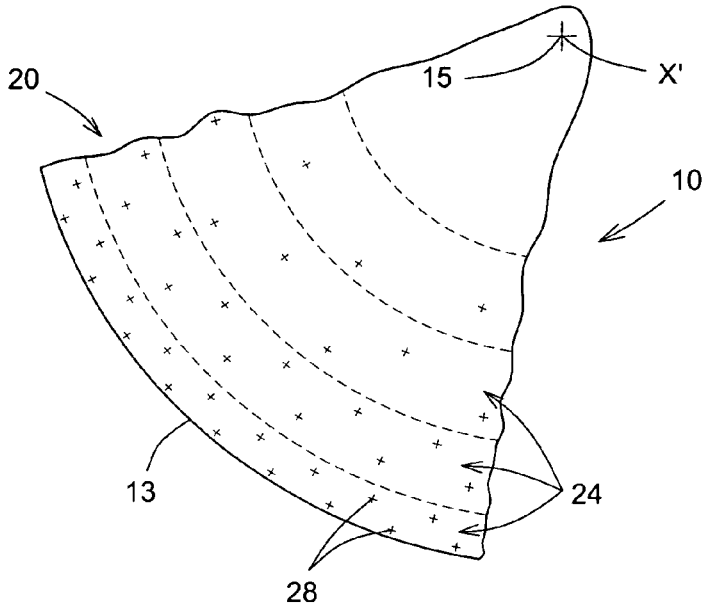
FIG. 3 is a simplified enlarged schematic view taken along line 3 of FIG. 2, showing typical electrical conductive and/or resistive elements on the substrate surface.

Typically, the pre-determined reflective pattern 24, shown, as an example only, as being generally circular with generally annular zones about a coverage directional axis X' corresponding to the approximate center of the antenna electromagnetic beam signal in FIG. 2, includes electrical conductive elements 28 supported by the substrate surface 16 to selectively modify the electromagnetic illumination of the reflector aperture 12, in a substantially radial (as illustrated) and/or circumferential directions. The electrical conductive elements 28 are typically made out of metallic and/or lossy material etched on the substrate surface 16, as shown in FIG. 3, with pre-determined sizes, shapes and configurations depending on the signal frequencies. The frequency-sensitive property pattern 22 may be achieved through a single or a multi-layer device.

Also, the pre-determined absorptive pattern 26 generally includes an electrically lossy sheet material 30 having a pre-determined thickness profile to selectively modify the electromagnetic illumination of the reflector aperture 12 in a substantially similar radial (as illustrated) and/or circumferential direction. A typical electrically lossy sheet material 30 is a substantially RF transparent material loaded with non-RF transparent (or electrically conductive) particulates such as a carbon loaded Kapton® or the like. Such electrically conductive particulates further improve the surface bleeding property of the membrane 10 protecting against possible damage due to electrostatic charge build-ups, especially in aerospace applications.

Typically, the electrically lossy sheet material 30 has a generally uniform thickness and is mounted on the substrate 14 to partially, preferably adjacent the outer or peripheral portion of the reflector aperture 12, cover the same that is used as the base or support layer.

Figure 4:
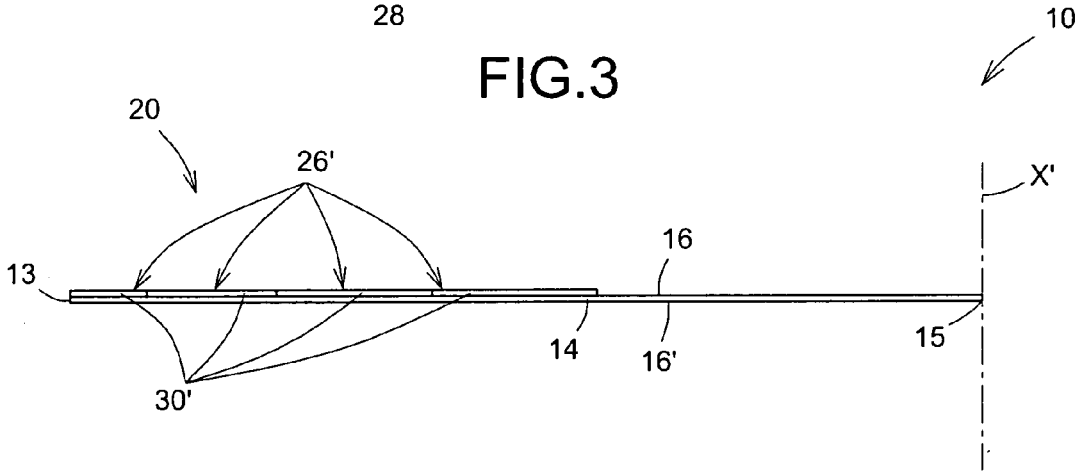
FIG. 4 is a simplified enlarged schematic view taken along line 4—4 of FIG. 2, showing the plurality of electrically lossy sheet materials mounted on the substrate surface in a side-by-side relationship relative to one another.
Figure 4A:
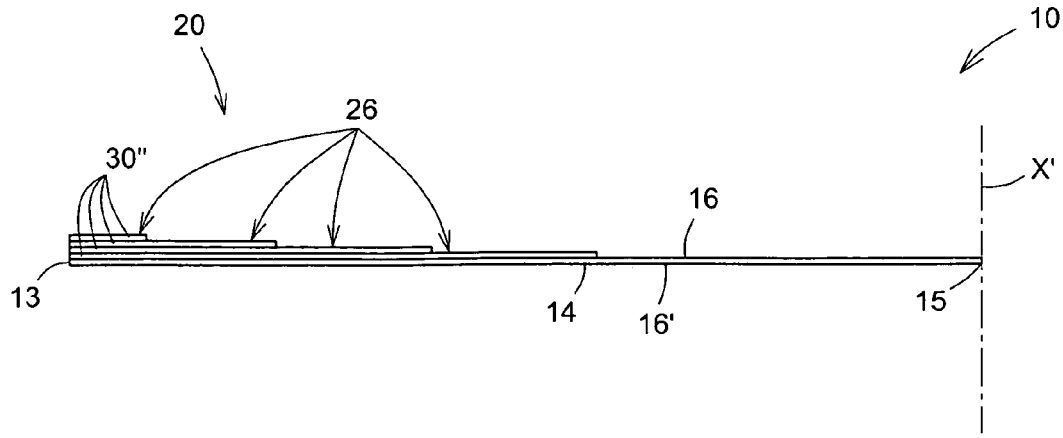
FIG. 4*a* is a view similar to FIG. 4, showing the plurality of electrically lossy sheet materials mounted on the substrate surface in an overlaying relationship relative to one another.

The absorptive pattern 26 may include a plurality of electrically lossy sheet materials 30', 30" mounted on the substrate surface 16 (typically stitched thereto) either in a side-by-side or in an overlaying relationship relative to one another, as shown in FIGS. 4 and 4*a*. Accordingly, in the first case, each electrically lossy sheet material 30' has a same thickness with a specific RF absorption property and covers at least a portion of the substrate surface 16 (shown as annular zones in FIG. 2) so as to provide the pre-determined absorptive pattern 26, as shown in FIG. 4. In the second case, each electrically lossy sheet material 30" could have a same thickness with a same RF absorption property but cover a different radial region of the reflector aperture 12 such that the overall thickness of the membrane device 10 varies in a radial direction to provide the pre-determined absorptive pattern 26, as shown in FIG. 4*a*. Similarly, the absorptive pattern 26 could vary in a circumferential direction or in both radial and circumferential directions across its plane without departing from the scope of the present invention.

Figure 6:
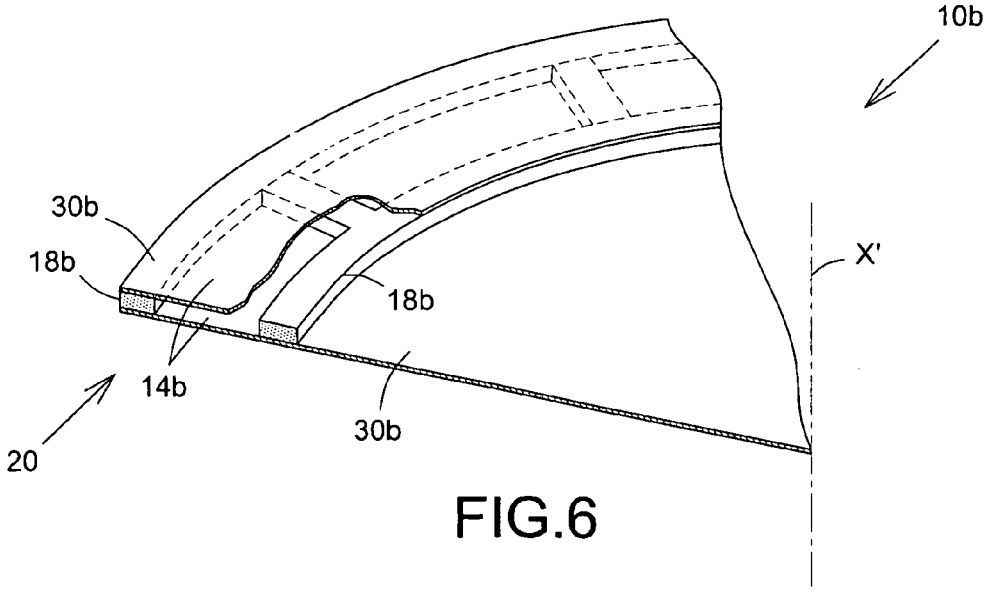
FIG. 6 is a simplified enlarged schematic section view of another embodiment of an aperture illumination control device in accordance with the present invention with a generally solid supporting member supporting two substrate sheets in a spaced apart relationship relative to each other.

As shown in FIG. 6, the device or membrane 10*b* includes a generally solid supporting member 18*b* in the form of a mesh made out of a substantially RF transparent foam or the like structural member. The supporting member 18*b* supports the substrate 14*b* made of a plurality (two illustrated in FIG. 6) of electrically lossy sheets 30*b* in a spaced apart relationship relative to one another and which form the illumination control means 20. The varying thickness of the substantially RF transparent material of the substrate 14*b* forms the frequency-sensitive property pattern 22 of the illumination control means 20. The supporting structure member 18*b* maintains the substrate 14*b* in a pre-determined geometry that is typically non-uniformly spaced apart from the reflector surface.

EXAMPLES

The following is a first example of use of an embodiment 10 of the present invention with a spacecraft antenna.

It is a well-known fact that the sidelobe levels of a reflector antenna can be controlled efficiently by controlling the aperture illumination law, and particularly the illumination distribution and taper towards the edges 13 of the aperture 12. When using reflector antennas where each beam is generated with a single feed element (typical of multimedia antennas), the close beam spacing leads to a feed cluster composed of tightly packed horns. The feed cluster geometry thus limits the maximum horn aperture diameter achievable, and only relatively small, lower gain, horns can be used. Assuming that a conventional horn design—such as a Potter horn—is employed, the small horn aperture sizes cannot generate the desired edge taper, pushing the design away from an optimum edge taper configuration. This limitation leads to antenna performance degradation, characterized by lower gain due to higher spillover losses, and higher sidelobe levels due to lower edge illumination taper.

Optimizing the aperture efficiency of the feed horn can alleviate this problem, by increasing the edge taper achievable with a given horn aperture diameter but, for some applications, the performance improvements obtained with a high performance multimode horn are insufficient.

Further increasing the edge taper beyond the optimum design point leads to higher overall efficiency losses, since it decreases the contribution of the aperture edges 13 to the far-field gain, and although the spill-over losses do diminish, they do so at a much slower rate and are thus unable to prevent the decrease in overall efficiency. However, achieving lower sidelobe levels would require increasing the edge taper, and hence a performance compromise, and design trade-off, becomes necessary. It should also be noted here that in evaluating the performance of antennas, edge-of-coverage (E.O.C.) gain usually takes precedence over the signal Carrier to Interference (C/I) ratio.

The reflector aperture illumination control device 10 of the present invention addresses a means of further controlling sidelobe levels while preserving, as much as possible, the efficiency gains obtained by the previous advancements in feed design. Specifically, it addresses the use of a sidelobe suppressing membrane in front of the reflector aperture 12, preferably integrated with the sunshield, as depicted schematically by FIG. 1. The device 10 controls the illumination distribution and taper towards the edges 13 of the aperture 12 through the use of RF absorbing and reflecting material 30, to partially absorb and reflect, in a controlled non-uniform manner, a small portion of the incident energy while transmitting the remaining portion there through.

It is also important to understand that the use of a membrane device 10 to control the aperture distribution allows going beyond what would appear to be achievable using the simple electromagnetic field aperture distributions representative of reflectors illuminated by a single horn. In fact, as is well known from antenna aperture synthesis theory, the optimal aperture distributions for sidelobe control can be rather complex and impossible to describe by a mere parameter such as edge taper. Taylor distributions, for example, are not uniformly descending towards the edges 13 of the aperture 12, and their more complex functional shape is essential to achieving the controlled sidelobe levels desired. The type of lossy sheet material 30 described hereinabove can in principle impart such more complex distributions onto the aperture illumination, thus in principle greatly expanding upon the achievable performance.

This sidelobe-control technique is believed to lead to the best compromise design when very low sidelobes are needed in order to maximize C/I isolation. The use of a membrane device 10 for sidelobe control is a very innovative way of achieving the best possible compromise between sidelobe levels (and consequently C/I) and main beam edge-of-coverage (E.O.C.) gain.

An example of a sidelobe suppressing membrane 10 in front of the reflector aperture 12 (a non-uniform non-RF transparent resistive sheet) has projected concentric rings (elliptical shape in general, circular being a particular case) with different resistivities, yielding generally increasing RF absorption and reflection, or decreasing RF transmission, from the center 15 towards the aperture edges 13, as shown schematically in FIG. 2. The generally planar membrane 10 is positioned substantially parallel to and adjacent the reflector outer edges E and can eventually be implemented as part of the reflector sunshield. Commercially available carbon-loaded Kapton® material can be used to achieve the membrane pre-determined frequency-related characteristics or properties. Alternative materials may be considered if needed to achieve different pre-determined electrical characteristics with the desired accuracy.

The membrane device 10 generally increases edge taper, although its transmissivity doesn't typically decrease monotonically towards the edge 13 of the aperture 12, but rather acquires a predefined or optimized non-monotonic functional behavior. As a result sidelobe levels decrease, enhancing C/I performance, the aperture illumination efficiency decreases, broadening the beam and contributing to decrease peak gain, however insertion (absorption) and reflection losses are introduced, which contribute to decrease gain. It should be noted that the objective is to maximize C/I while preserving edge-of-coverage (E.O.C.) gain, not peak gain, i.e. to generate a flatter beam across the coverage spot.

The following is a second example of use of another embodiment of the present invention with a spacecraft antenna.

There is an emerging requirement in the satellite multimedia payload market for multiple beam antennas operating simultaneously at both the transmit (Tx) and receive (Rx) frequency sub-bands, in order to enable accommodation of an ever increasing number of antennas within the very limited allowed envelopes on-board multimedia geo-stationary satellites or the like. This requires the development of designs and technologies that are capable of achieving such challenging dual-frequency mode of operation (e.g. 20 GHz/30 GHz for Ka-band) while minimizing the impact on performance.

Although the antenna feed horns can be designed to operate and perform at optimal efficiency over both frequency sub-bands, in an optimal feed design the primary radiation patterns will not be identical at the two frequencies, thus leading to different reflector aperture illumination functions and different aperture efficiencies. This problem is compounded by the fact that the equivalent aperture size required is different at the two frequencies if the same level of gain and the same size of beam footprint on the ground are sought. The higher Rx frequency would in fact require a smaller equivalent aperture dimension, i.e. a lower antenna efficiency, than the Tx frequency, otherwise, if the equivalent apertures are of similar size, the gain of the Rx beam will be greater and its beam foot-print size on the ground will be smaller.

The membrane device 10 of the present invention is used to equalize the gain and footprint size at the Tx and Rx frequencies by functioning as a "spatial filter" that impacts the Rx and Tx signals differently, so as to exactly compensate for the unequal performances. The physical embodiment consists of placing a partially frequency selective surface (FSS) or device 10 in front of the reflector aperture 12, preferably integrated with the reflector sunshield. The frequency-related characteristics of the FSS 10 are not uniform, but rather vary significantly from the center 15 to the edges 13 of the aperture 12 (substantially radially). The optimal FSS 10 design is substantially RF transparent at Tx while reflecting some of the incident Rx energy adjacent the edges 13 of the aperture 12, while being perfectly transparent to both Tx and Rx adjacent the center 15 of the aperture 12. The membrane device 10 thus controls differently the Rx and Tx reflector illumination functions near the aperture edges 13, but has little effect on that illumination away from the edges 13, thus it can be designated as a partial frequency selective surface. By proper synthesis of the partial FSS frequency-related characteristics and the feed pattern, the best possible performance at both Rx and Tx can be achieved.

The use of a partial FSS membrane 10 for differential Rx/Tx edge illumination allows the achievement of the best balance between Tx and Rx performances.

Alternatives

Although not shown hereinabove, it should be obvious to one skilled in the art that the substrate could be configured as a mesh or have a generally elliptical shape without departing from the scope of the present invention.

Similarly, depending of the required transmit pattern 26, it would be obvious to one skilled in the art that the different electrically lossy sheet materials 30', **30*b*** could have different thicknesses without departing from the present invention if different materials are considered.

Also, it would be obvious to one skilled in the art that the membrane device 10, **10*a*, 10*b*** could be used over any lens, shaped reflector or sub-reflector that could be concave and/or convex, or over any type of feed horn or even feed array without departing from the scope of the present invention.

Furthermore, it would be obvious to one skilled in the art that the membrane device can be designed such that its electrical properties typically vary radially and/or circumferentially following a smooth profile instead of the discrete multiple zone embodiments hereinabove described.

Although the present aperture illumination control device has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

We claim:

1. A device for modifying electromagnetic illumination of a reflector aperture defined by a reflector surface, the device mounting in front of and substantially overlapping the reflector aperture in a spaced apart relationship relative to the reflector surface and extending to a proximity of a reflector outer edge all around a perimeter of the reflector aperture, thereby at least partially covering the reflector aperture, said device providing an illumination control means for at least partially and selectively modifying electromagnetic illumination of the reflector aperture.

2. The device of claim 1, further including a substrate for mounting in a spaced apart relationship relative to the reflector surface, said substrate being substantially transparent to electromagnetic radiation, said substrate at least partially covering the reflector aperture, said illumination control means connecting to said substrate for at least partially and selectively modifying electromagnetic illumination of the reflector aperture.

3. The device of claim 2, wherein said substrate is in a non-uniform spaced apart relationship relative to the reflector surface.

4. The device of claim 3, wherein the reflector surface defines a reflector axis generally perpendicular thereto, and wherein said illumination control means selectively modifies electromagnetic illumination of the reflector aperture in a substantially radial and/or circumferential direction.

5. The device of claim 4, wherein said illumination control means includes RF transmission and/or absorption and/or reflection coefficient profile that follows a pre-determined pattern.

6. The device of claim 2, wherein said substrate is a support mesh.

7. The device of claim 2, wherein said substrate is a support sheet.

8. The device of claim 2, wherein said substrate entirely covers the reflector aperture.

9. The device of claim 2, wherein said illumination control means has a frequency-sensitive property pattern.

10. The device of claim 9, wherein said frequency-sensitive property pattern includes an RF reflection coefficient profile that follows a pre-determined reflective pattern.

11. The device of claim 10, wherein said pre-determined reflective pattern includes electrical conductive elements supported by at least a surface of said substrate.

12. The device of claim 11, wherein said pre-determined reflective pattern selectively modifies electromagnetic illumination of the reflector aperture in a substantially radial and/or circumferential direction.

13. The device of claim 12, wherein said electrical conductive elements are metallic.

14. The device of claim 13, wherein said electrical conductive elements are etched on at least a surface of said substrate.

15. The device of claim 9, wherein said frequency-sensitive property pattern includes an RE absorption coefficient profile that follows a pre-determined absorptive pattern.

16. The device of claim 15, wherein said pre-determined absorptive pattern selectively modifies electromagnetic illumination of the reflector aperture in a substantially radial and/or circumferential direction.

17. The device of claim 16, wherein said pre-determined absorptive pattern includes an electrically lossy sheet material having a pre-determined thickness profile.

18. The device of claim 17, wherein said substrate is said electrically lossy sheet material.

19. The device of claim 16, wherein said pre-determined absorptive pattern includes at least one electrically lossy sheet material mounted on at least a surface of said substrate, said electrically lossy sheet material covering at least a portion of said substrate surface so as to provide said pre-determined absorptive pattern.

20. The device of claim 2, further including a supporting member for supporting said substrate in a spaced apart relationship relative to the reflector surface.

21. The device of claim 20, wherein said supporting member in substantially transparent to electromagnetic radiation.

22. The device of claim 20, wherein said supporting member is a mesh.

23. The device of claim 2, wherein said substrate includes a plurality of sheets spaced apart from one another.

* * * * *